United States Patent [19]

Grundstedt et al.

[11] Patent Number: 4,678,018

[45] Date of Patent: Jul. 7, 1987

[54] SCREEN ARRANGEMENT

[75] Inventors: Peter Grundstedt, Sundbyberg; Bill Taube, Spånga, both of Sweden

[73] Assignee: Hennix i Stockholm AB, Sundbyberg, Sweden

[21] Appl. No.: 826,599

[22] Filed: Feb. 6, 1986

[30] Foreign Application Priority Data

Feb. 15, 1985 [SE] Sweden ..... 8500730

[51] Int. Cl.[4] ..... A47G 5/00

[52] U.S. Cl. ..... 160/135; 160/351; 211/195

[58] Field of Search ..... 160/135, 351, 352, 232, 160/235; 211/169, 189, 195; 40/605, 606, 539, 610, 155; 403/DIG. 10

[56] References Cited

U.S. PATENT DOCUMENTS

| | | | |
|---|---|---|---|
| 1,282,685 | 10/1918 | Goldhahn . | |
| 3,700,385 | 10/1972 | Sherwood | 160/135 X |
| 3,768,222 | 10/1973 | Birum, Jr. . | |
| 4,030,219 | 6/1977 | Donovan | 160/135 X |
| 4,147,198 | 4/1979 | Ytter | 160/135 |
| 4,166,332 | 9/1979 | Donovan | 160/135 X |
| 4,410,027 | 10/1983 | Lucous . | |
| 4,436,135 | 3/1984 | Ytter | 160/135 |

OTHER PUBLICATIONS

European Search Report EP 86850048.9.

*Primary Examiner*—Ramon S. Britts
*Assistant Examiner*—David M. Purol
*Attorney, Agent, or Firm*—Burns, Doane, Swecker & Mathis

[57] ABSTRACT

An exhibition screen arrangement is formed by a plurality of mutually joined rightangular frames, foldable in two directions relative each other, which are arranged in two sets (1,2), one end frame in each set being foldably connected to each other about a hinge (4). The side frame members (101,201) in both sets (1,2) are each formed by two parallel, spaced section elements (30), with an undercut projection (31). The elements (30) are mutually alike and are oriented in each such side member for mutually forming one half of a dovetail joint. The projections (31) are formed with cuneiform surfaces so that the dovetail joint is established by snap-lock action, the sections (30) deflecting out in a direction normal to the plane of the frame. The turned-over portions (33) of the projections are tapered towards the end of the respective element (30) so that the edge section of the turned-over portion (33) of the element projection is substantially adjusted to the deflection curve of the element.

15 Claims, 7 Drawing Figures

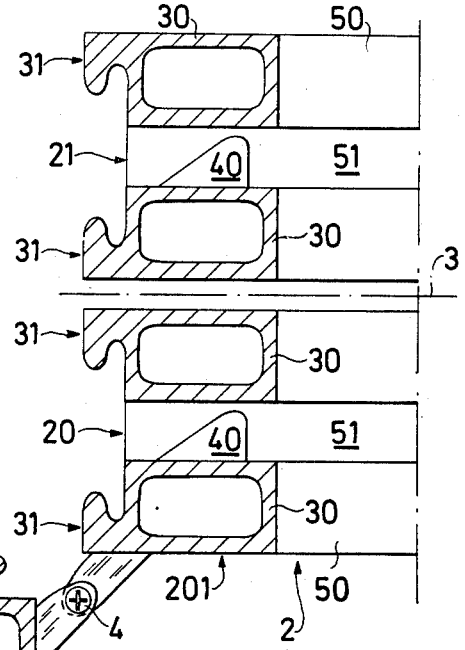
Fig. 4
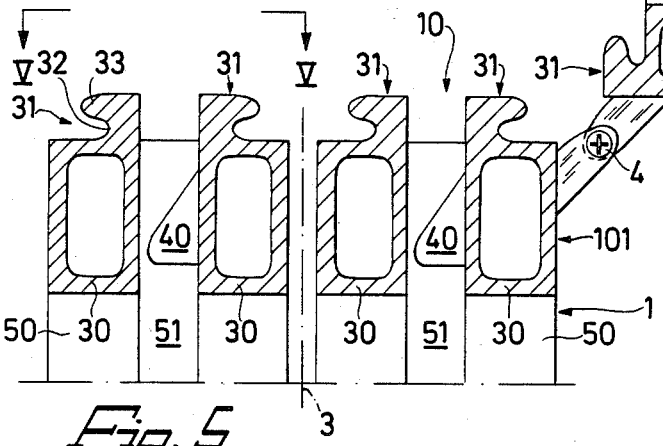
Fig. 5
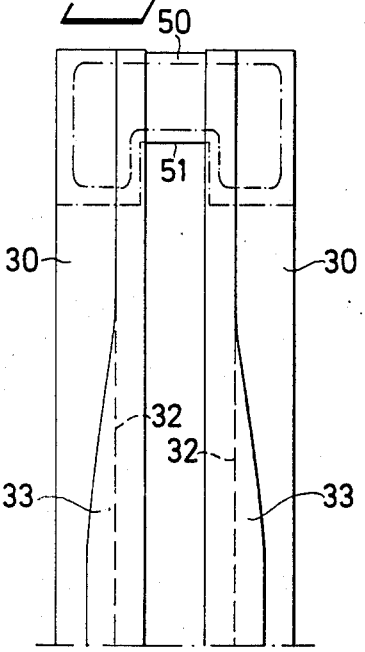
Fig. 6
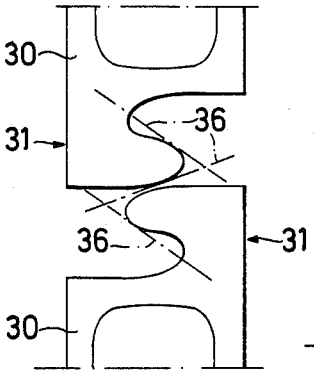
Fig. 7
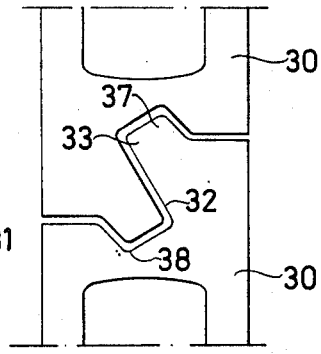

SCREEN ARRANGEMENT

TECHNICAL FIELD

The invention relates to a screen arrangements of the kind including a plurality of collapsible, cohesive right-angular frames for screen panels.

Screen arrangements of the mentioned kind, which are usually used as exhibition screens, have their great advantage in that they are collapsible for being readily transported to and from their exhibition location. These screens are very often handled by persons who have not previously erected them. The screens of the prior art generally function well but have some disadvantages. One disadvantage is that a separate locking element is required to stabilise the screen arrangement in an erected condition. This locking element has been manufactured as a separate item, and it has been found that it very often becomes mislaid and thus is not assembled with the erected screen. It has also been found that the element is not utilised even when it is available, since its use and location do not appear simple or necessary for the staff erecting the screen. Furthermore, it has been found that there are minor practical difficulties in a screen arrangement of the kind mentioned, with respect to inserting or removing the screen panels in or from the frames included in the arrangement, the panels having a tendency to fall out through the insertion slot, or being difficult to remove from the frame. A further disadvantage has been that in order to stabilise the frames included in the screen arrangement against each other to a certain extent in its erected state, frame side members formed as male and female have been utilised. The use of male and female sections has meant that in fabricating the screen arrangement it has been necessary to store sections for both male and female side members.

OBJECTS AND SUMMARY OF THE INVENTION

One object of the invention has therefore been to provide a screen arrangement in which at least some of the mentioned disadvantages have been eliminated or mitigated.

The invention is based on a screen arrangement of the kind mentioned in the introduction and is essentially distinguished in that each element of the frame on each side facing towards the outer periphery of the frame has along its length an undercut projection, the junction between the elements being bevelled, in that these elements are mutually alike and have complementary contours on said side, that the elements in a frame side member are opposingly directed to form the female part of a dovetailed joint and that the coacting frame side member has its elements oriented such as to form the male portion of the joint, the elements being arranged to bend out in the direction normal to their frame planes when the joint is established or broken by folding the sets of joined frames about said second hinge. The joint is broken or established by folding the sets of joined frames about the second hinge. When the joint has been established and the screen surfaces, held together vertically, of the screen arrangement are folded away from each other, the joint is sufficiently strong to prevent the frame side members connected to each other from going free from each other due to normal force action in the axial direction of the hinge, e.g. by the screen arrangement being lifted at its upper edge. The need of separate locking elements is thus avoided. The remaining frame side sections in each frame can be formed from a single section with a recess facing towards the inside of the frame, this recess being suited to accommodate the edge area of a screen panel. The elements suitably have a like section. The shape of the projecting portion of the elements can be adjusted at the ends of the element to its bending curve when the joint is established and broken.

A generally triangular spacer body can be fitted with one side surface on one element between both elements of the frame, one free side of the body forming together with the other element a cuneiform insertion gap for the screen panel, the other free side of the body extending substantially at right angles to the plane of the frame to prevent a panel inserted in the frame from falling out between the frame elements.

The spacer body can thus limit the deflection towards each other of the elements to some extent, in which case the projection of the contiguous frame side member should be adjusted to this condition.

The other free side of the spacer body may be disposed set away from the inner surface of the frame to allow the edge of the panel to be placed between the elements. The spacer body preferably has a length which is a fraction of that of the element, the spacer body suitably being fitted between the ends of the elements and preferably at half the length thereof.

The invention will now be described in detail with the aid of an exemplifying embodiment and with reference to the accompanying drawing.

BRIEF DESCRIPTION OF THE DRAWING

FIG. 4 is a section taken along the line IV—IV in FIG. 1.

FIG. 5 is a view taken along the line V—V in FIG. 4.

FIG. 6 is a detail view of how the section elements in the contiguous frame side members of the sets of joined frames are formed for mutual coaction.

FIG. 7 illustrates another preferred contour of the element sections.

DETAILED DESCRIPTION OF THE PREFERRED EMBODIMENTS

Figure 1:
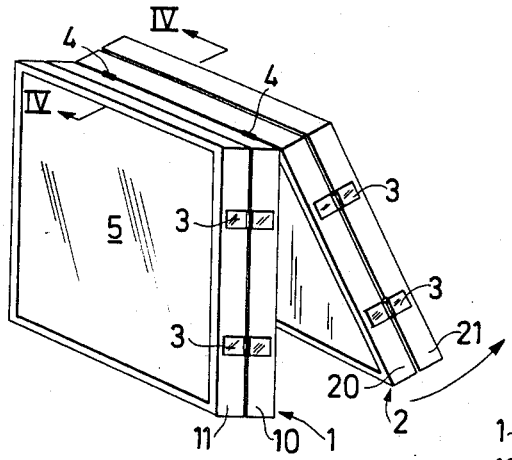
FIG. 1 is a perspective view of a screen arrangement in accordance with a preferred embodiment of the present invention in a collapsed or folded-up condition.
Figure 2:
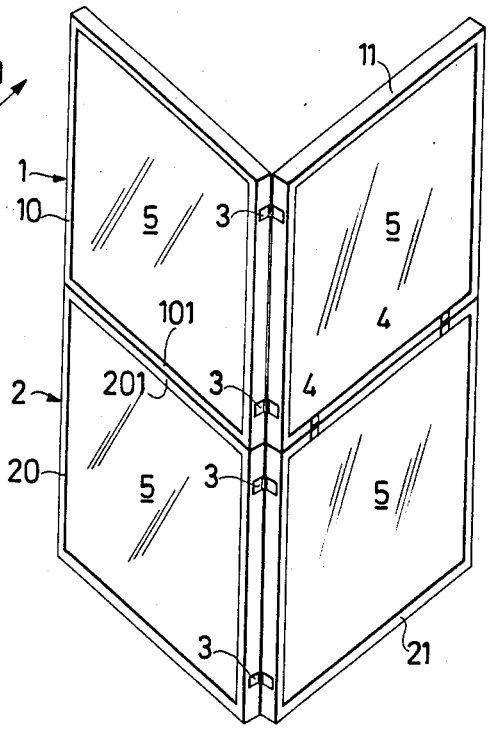
FIG. 2 is a perspective view of the screen arrangement of FIG. 1 in an erected condition.

FIGS. 1 and 2 illustrate a screen arrangement in accordance with a first preferred embodiment of the invention. FIG. 1 illustrating the arrangement in a folded-up condition and FIG. 2 illustrating the arrangement in an erected condition. The screen arrangement includes two sets 1 and 2, of frames 10,11 and 20,21 respectively. The screen panels 5 are inserted in the frames. The panels 5 may carry information directly or form a substructure for mounting information material. Alternatively, the screen arrangement may be intended to function purely as a screening arrangement. The screens 10,11 in one set 1 and the screens 20,21 in the other set 2 are mutually connected with the aid of hinges 3, which are preferrably disposed for giving the frames a mutual foldability of over 360°. The frame sets 1,2 are mutually connected via hinges 4 between the end frames 11,21 in each set. The axis of the hinges 4 is substantially in the free main surface of the collapsed sets. To allow stabilization of the frames in the erected condition of the screens according to FIG. 2, at least the second end frame 10,20 in each set is formed with mutually contiguous frame side members 101,201, fabricated in the way more clearly apparent from FIGS. 4–6.

From FIG. 4 it will be seen that the frame side members in question are formed by a pair of somewhat separated section elements 30, having a projection 31 with an undercut 32 and a turned-over portion 33. The elements 30 are mutually alike but oriented in different directions so that in each frame side member the projections 31 of a pair of elements 30 form one half of a dovetail joint. For example, it may be seen that the side member 101 of the frame 10 is arranged as male and that the side member 201 of the coacting frame 20 is arranged as female, the coacting side members of the frames 11,21 being arranged in a corresponding manner. Each hinge 4 is disposed close to one of the two opposing free outer surfaces of each set and in such a position that the frame side members are brought into full engagement with each other by pivoting the sets 1,2 about the hinges 4, when the female-configurated side members snap over the male configurated side members.

The other side members of the frames 3 are formed from a section 50 with a groove 51, the width of which corresponds to the mutual spacing between the section elements 30. The ends of the section elements 30 are rigidly connected to the sections 50.

Two structural properties are required for the dovetail joint to be established or broken. One is that the projections of the elements 30 are formed to provide a wedging action on coaction so that the elements can bend out essentially in a direction normal to the frames, as is indicated by the lines 36 in FIG. 6, which illustrate the position of the cuneiform surfaces in relation to the elements.

The second property is that for two element projections 31 engaging with each other, the portion 33 of one of the projections 31 is removed at either end of the element 30.

As will be seen from FIG. 5, at the end region of the element 30 the portion 33 is removed to an increasing extent in a direction towards the ends of the element. The distance along which the portion 33 is removed is adjusted to the deflection curve of the element when the joint is broken or established.

Halfway along the elements 30 there is a triangular spacer body 40, which is attached to one of the elements 30 in a frame side member. One surface of the spacer body 40 forms a cuneiform insertion gap for a panel 5, and forms with its other surface a latch preventing the panel 5 from falling out. Due to the slenderness of the elements 30, they may easily be sprung apart for taking out the panel 5 through the thus expanded gap between the elements 30 in a frame side member.

The elements 30 are mutually entirely alike and complementary, at least with respect to their projections 31. The elements 30 as well as the section 50 can advantageously be extruded sections of light metal, e.g. aluminium.

Although it is not more clearly shown on the drawing, the screen arrangement can be provided with supporting feet if so desired.

Figure 3:
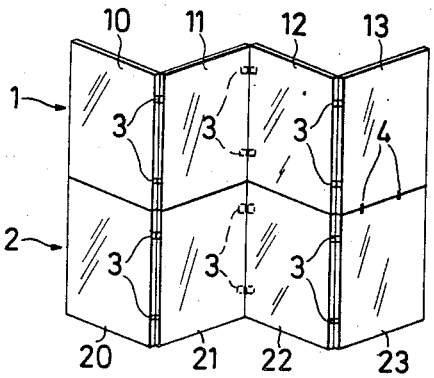
FIG. 3 is a perspective view of a screen arrangement in accordance with another preferred embodiment of the invention with a larger number of frames than the arrangement according to FIGS. 1 and 2.

The screen arrangement described above includes four frames, but it should be clear that the invention is just as usable for arrangements with a greater number of frames, e.g. as is illustrated in FIG. 3, from which it will be seen that the frame sets 1,2 have been increased with further frames 12,13 and 22,23, the hinges 4 connecting the end frames 13,23 of the sets 1,2 and the other end frames 10,20 being provided with mutually contiguous frame side members 101,201 in accordance with the embodiment according to FIGS. 4–6.

By forming, in accordance with the invention, the mutually adjoining frame side sections on both sets of frames as snap-locking dovetail joints, the screen arrangement is stabilized in its erected condition so that the screens may even be lifted at their upper edges without risk of the frames falling apart from each other. Furthermore, the frames are prevented from unintentionally being pulled apart from each other. As a result of the invention, the coacting side members may be formed from a single element section, which simplifies fabrication of the frames and their arrangement to a great extent.

In the embodiment described above of the section elements 30 there is required (for a given bending stiffness of the element) a relatively heavy undercut 32 of the projections 31 and a corresponding large deflection of the elements 30 when the joint is to be established or broken. This heavy deflection is the reason for the tapering off of the projections illustrated in FIG. 5.

According to a further development of the invention illustrated in FIG. 7, a longitudinal bead 37 is arranged on the upper side of the projection 31 adjacent the undercut side of the projection, the projection sides of the coacting section elements having complementary and like sections.

Due to the bead 37 and the recess 38 complementary to the bead 37, taking apart the element profile is made more difficult in a direction normal to the plane of the frames. As mentioned, the joint is broken by pivoting the frames about the hinges 4, whereon the bead 37 (due to the play between the coacting elements) leaves the recess 38 to a certain extent before the undercut projection surfaces exercise wedging action against each other, so that the section elements are bent apart from each other, the bead going into engagement with its recess wall to start with, and thus making more difficult the deflection of the section element. It is thus possible to have a less heavy undercut of the side surfaces of the projection (less deflection of the element sections) and tapering off the projections at the end of the element sections is not necessary.

It is to be understood that the present invention may be embodied in other specific forms without departing from the spirit or essential characteristics of the present invention. The preferred embodiments are therefore to be considered illustrative and not restrictive. The scope of the invention is indicated by the appended claims rather than by the foregoing descriptions and all changes or variations which fall within the meaning and range of the claims are therefore intended to be embraced therein.

We claim:

1. A foldable screen arrangement for supporting a plurality of panels, comprising a plurality of collapsible cohesive rightangular frames for receiving screen panels, said frames being disposed in at least two sets of frames foldably connected to each other, one frame in each set being foldably connected to a frame in the other set by hinge means, the frames in each set having frame side members which are mutually contiguous in an unfolded condition of the screen, each of the frame side members comprising two parallel, separate section elements between which a panel may be inserted in the respective frame, each section element on its side facing toward the outer periphery of the frame having along its length a projection with an undercut side surface, a junction between the undercut side surface and an upper surface of the projection being bevelled, the section elements in one of the frame side members being opposingly directed to form a female portion of a dovetailed joint and the other frame side member having its section elements oriented so as to form the male portion of the dovetailed joint, the section elements being independently flexible in a direction normal to their frame plane, said male and female joint portions arranged to at least partially overlap each other in said normal direction, whereby as the dovetailed joint is established or broken by folding the sets about said hinge means, the section elements bend in said normal direction.

2. The screen arrangement as claimed in claim 1, wherein each projection of the section element has on its upper side adjacent its undercut side surface a longitudinal bead and a recess complemental to the bead.

3. The screen arrangement as claimed in claim 1, wherein end regions of the projections on the male portion of the dovetailed joint is increasingly bevelled on in a direction toward the respective end.

4. The screen arrangement as claimed in claim 1, wherein remaining frame side members of each frame comprise a single frame section member having a recess facing toward the inside of the frame and adapted to accommodate an edge portion of a panel.

5. The arrangement as claimed in claim 1, wherein a generally triangular spacer body is provided on one side surface of one of the section elements between both section elements of the frame, the spacer body forming with the other section element an insertion gap so that a panel may be inserted into the frame between said spacer body and said other section element, a side of the spacer body extending substantially at a right angle to the frame plane so as to prevent a panel inserted in the frame from falling out between the section elements.

6. The screen arrangement as claimed in claim 2, wherein remaining frame side members of each frame comprise a single frame section member having a recess facing toward the inside of the frame and adapted to accommodate an edge portion of a panel.

7. The screen arrangement as claimed in claim 3, wherein remaining frame side members of each frame comprise a single frame section member having a recess facing toward the inside of the frame and adapted to accommodate an edge portion of a panel.

8. The arrangement as claimed in claim 2, wherein a generally triangular spacer body is provided on one side surface of one of the section elements between both section elements of the frame, the spacer body forming with the other section element an insertion gap so that a panel may be inserted into the frame between said spacer body and said other section element, a side of the spacer body extending substantially at a right angle to the frame plane so as to prevent a panel inserted in the frame from falling out between the section elements.

9. The arrangement as claimed in claim 3, wherein a generally triangular spacer body is provided on one side surface of one of the section elements between both section elements of the frame, the spacer body forming with the other section element an insertion gap so that a panel may be inserted into the frame between said spacer body and said other section element, a side of the spacer body extending substantially at a right angle to the frame plane so as to prevent a panel inserted in the frame from falling out between the section elements.

10. The arrangement as claimed in claim 4, wherein a generally triangular spacer body is provided on one side surface of one of the section elements between both section elements of the frame, the spacer body forming with the other section element an insertion gap so that a panel may be inserted into the frame between said spacer body and said other section element, a side of the spacer body extending substantially at a right angle to the frame plane so as to prevent a panel inserted in the frame from falling out between the section elements.

11. The arrangement as claimed in claim 6, wherein a generally triangular spacer body is provided on one side surface of one of the section elements between both section elements of the frame, the spacer body forming with the other section element an insertion gap so that a panel may be inserted into the frame between said spacer body and said other section element, a side of the spacer body extending substantially at a right angle to the frame plane so as to prevent a panel inserted in the frame from falling out between the section elements.

12. The arrangement as claimed in claim 7, wherein a generally triangular spacer body is provided on one side surface of one of the section elements between both section elements of the frame, the spacer body forming with the other section element an insertion gap so that a panel may be inserted into the frame between said spacer body and said other section element, a side of the spacer body extending substantially at a right angle to the frame plane so as to prevent a panel inserted in the frame from falling out between the section elements.

13. The screen arrangement as claimed in claim 1, wherein said section elements have similar profiles and are arranged in said frame side members in complementary orientations.

14. A foldable screen arrangement, comprising:

first and second, generally planar frames adapted to receive screen panels within said frames, said first and second frames each comprising a plurality of frame members;

means for pivotally connecting said first and second frames so that in an unfolded condition of the screen arrangement, a first frame member of said first frame is generally parallel to and opposes a second frame member of said second frame;

each of said first and second frame members comprising spaced longitudinal section elements which are independently flexible in a direction normal to the plane of the frame, said first and second frame members provided with projections disposed along said longitudinal section elements, in said unfolded condition said projections on said first frame member at least partially overlapping in said normal direction said projections on said second frame member, said projections having a profile such that as said first and second frames are pivoted into the unfolded condition of the screen arrangement, the longitudinal sections are deflected in said normal direction and said projections of the first and second frame members are releasably interconnected;

each first and second frame member provided with means for retaining a panel within the frame during the interconnection and release of said projections.

15. The screen arrangement as claimed in claim 14, wherein said longitudinal section elements of each of said first and second frame members having spaced, opposing surfaces, said opposing surfaces defining an opening into the frame for insertion of panels, said retaining means comprising a spacer body at a location along one of said opposing surfaces, said spacer body extending partially across said opening, said longitudinal sections bendable in said normal direction sufficiently to provide clearance for a panel between said spacer body and the other opposing surface, whereby a panel may be inserted into the frame.

* * * * *